US007140889B1

(12) United States Patent
Shah et al.

(10) Patent No.: US 7,140,889 B1
(45) Date of Patent: Nov. 28, 2006

(54) SYSTEM FOR PHYSICALLY SECURING AN ACCESS POINT AND PREVENTING THE REMOVAL OF ASSOCIATED CONNECTORS

(75) Inventors: Malay Shah, Medina, OH (US); Raymond Molnar, Hudson, OH (US); Leonard Scott Lindner, Hudson, OH (US)

(73) Assignee: Cisco Technology, Inc., San Jose, CA (US)

( * ) Notice: Subject to any disclaimer, the term of this patent is extended or adjusted under 35 U.S.C. 154(b) by 294 days.

(21) Appl. No.: 10/266,377

(22) Filed: Oct. 8, 2002

(51) Int. Cl.
*H01R 13/44* (2006.01)

(52) U.S. Cl. ..... 439/133; 439/131; 439/136

(58) Field of Classification Search ..... 439/151, 439/149, 148, 304, 133, 136, 147
See application file for complete search history.

(56) References Cited

U.S. PATENT DOCUMENTS 5,169,332 A * 12/1992 Cooke et al. ..... 439/304
5,220,815 A * 6/1993 Davidge et al. ..... 70/14
5,710,728 A * 1/1998 Danielson et al. ..... 713/321
6,454,579 B1 * 9/2002 Davis ..... 439/134

* cited by examiner

*Primary Examiner*—Chandrika Prasad
(74) *Attorney, Agent, or Firm*—Tucker Ellis & West LLP

(57) ABSTRACT

This invention is directed to a security system for wireless access points which includes a clamp assembly and a locking device. The clamp assembly is clamped around I/O panel connectors, and then secured to the access point enclosure frame via a metal capture plate. The metal capture plate extends from an end of the clamp assembly and engages the lower half of the access point enclosure frame, securing the clamp assembly to the access point. Additionally, the locking device locks the clamp assembly halves in a closed position, thus preventing removal of the access point and blocking any unauthorized users from accessing the I/O ports.

8 Claims, 7 Drawing Sheets

SYSTEM FOR PHYSICALLY SECURING AN ACCESS POINT AND PREVENTING THE REMOVAL OF ASSOCIATED CONNECTORS

BACKGROUND OF THE INVENTION

This invention is directed to physical security systems for wireless access points. More particularly, this invention is directed to a physical security system for wireless access points which is comprised of a clamp assembly and a locking device.

Users of wireless access points are concerned about the physical security of distributed access points throughout their facilities. These security concerns include theft of the access points and hacking into the user's network via unauthorized access to the access point's I/O panel connectors, such as the Ethernet, fiber and/or console port connectors.

To address these security problems, access point users are placing the access points in metal security boxes to secure the access points. However, this solution results in other problems, such as degradation of the thermal design due to excessive heating of the access point which leads to lowered reliability, early product failure, and high warranty return costs. This solution also causes degradation and compromise of the electrical, electromagnetic compatibility, and regulatory certification of the access point. Further, it leads to destruction of the branding and esthetic design of the access point's standard enclosure as the brand name and design are hidden inside the metal box. In addition, the access point's visual indicators, such as the status indicators and the Ethernet indicators are hidden from the user. Furthermore, the installation of the security boxes is expensive and time consuming.

There is a need for a security system for wireless access points which overcomes these limitations.

SUMMARY OF THE INVENTION

In accordance with the present invention, there is provided a physical security system for wireless access points which overcomes the limitations of earlier security systems.

Further in accordance with the present invention, there is provided a security system for access points which prevents theft, I/O panel connector/antenna removal, and access to the ports by unauthorized users. Additionally, the security system does not hide the branding and esthetic design of the access point enclosure.

The security system comprises a clamp assembly and a locking device. The clamp assembly includes a spring loaded hinge pin which secures the two clamp assembly halves together. The clamp assembly is then clamped around at least one I/O panel connector, and then secured to the access point enclosure frame via a metal capture plate. The metal capture plate extends from an end of the clamp assembly and engages the lower half of the access point enclosure frame, securing the clamp assembly to the access point. Additionally, a locking device locks the clamp assembly halves in a closed position, thus preventing removal of the access point and blocking any unauthorized users from accessing the I/O ports.

Advantages of the security system, include, but are not limited to, easy and inexpensive installation, elimination of thermal degradation of the access point, does not compromise the ventilation of the access point enclosure, does not compromise the access point's electrical and regulatory aspects, and allows the visibility of all the access point's visual indicators.

These and other aspects of the present invention are herein described in further detail, with reference to the accompanying Figures, the illustrated embodiments being representative of only some of the ways in which the principles and concepts of the invention can be executed and employed.

DETAILED DESCRIPTION OF PREFERRED AND ALTERNATE EMBODIMENTS

Figure 1:
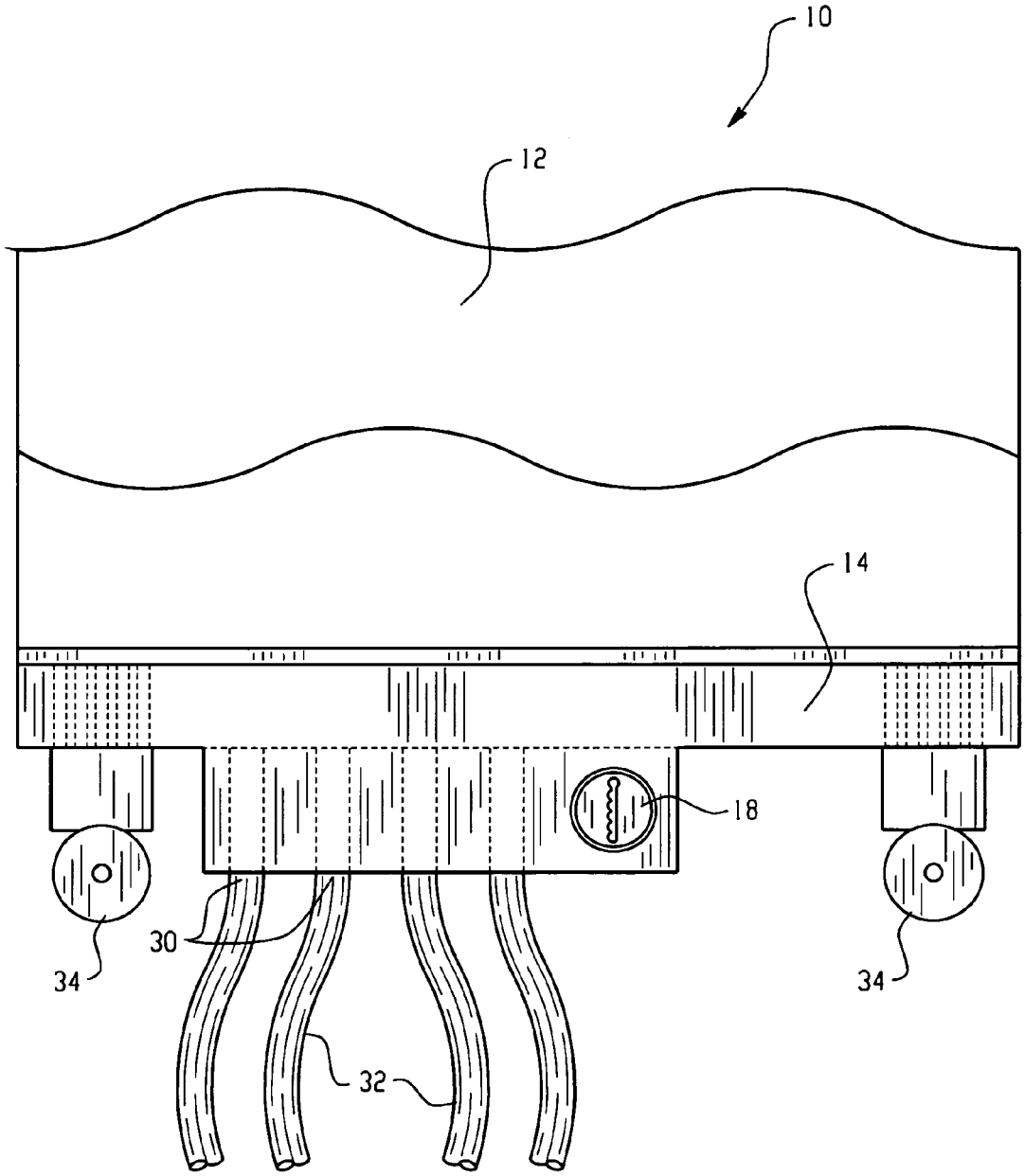
FIG. 1 is a top view of the security system of the present invention.

The present invention is directed to a physical security system for wireless access points. FIG. 1 shows a preferred embodiment of the system according to the present invention, generally designated 10. The system 10 comprises a clamp assembly 14 and a locking device 18 which are secured to an access point, to prevent theft of the access point and to prevent removal or access of the I/O panel connectors 32 and antennas 34 of the access point.

The clamp assembly 14 is designed to clamp around various I/O panel connectors, such as Ethernet connectors 32, fiber connectors 32, console port connectors 32, and/or antennas 34 connected to the access point. The clamp assembly 14 also securably attaches to a portion of the access point. This prevents removal of the access point, and physically blocks any unauthorized user from accessing the I/O ports.

In a preferred embodiment, a framing 12 encloses the access point protecting it from damage. The clamp assembly 14 is then secured to the access point enclosure frame 12, as an integral part of the access point enclosure frame 12. The clamp assembly 14 is secured around the connectors 32 and antennas 34 and then attached to the access point enclosure frame 12, preventing removal or access to the access point. In another embodiment, a "Kensington" lock-style hole is incorporated into the clamp assembly 14, allowing a dual-redundant lockup cable to further secure the access point enclosure frame 12. The "Kensington" lock is a locking device designed to lock into a small rectangular hole in the case of a small device, e.g., a laptop PC, to secure the device to a stationary object.

Figure 4:
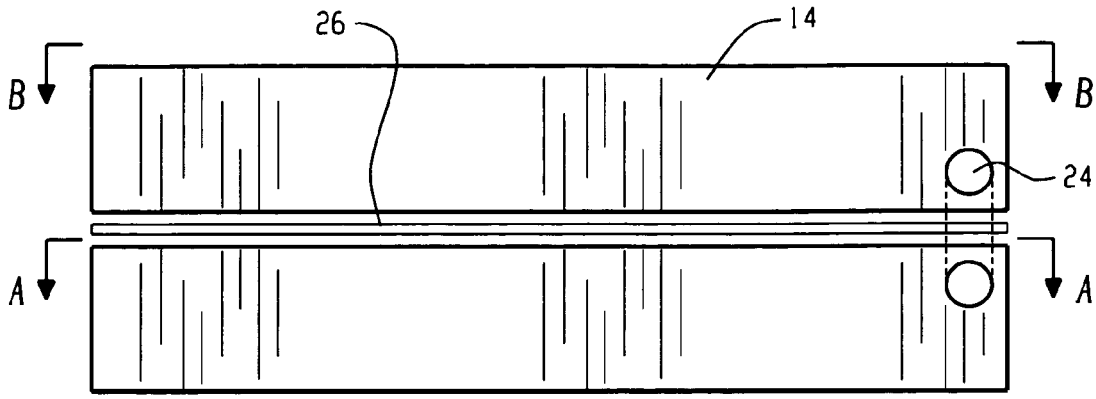
FIG. 4 is an elevation view of the clamp assembly of the present invention.
Figure 3:
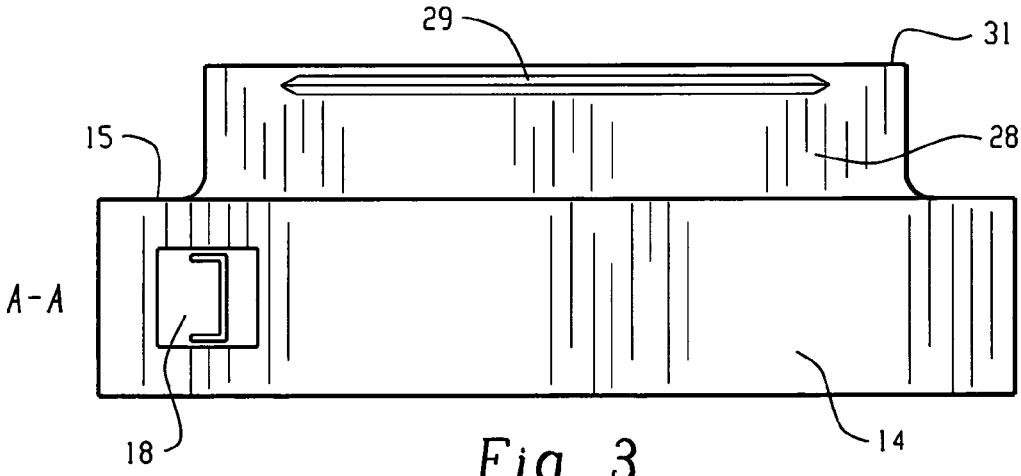
FIG. 3 is a bottom view of the clamp assembly of the present invention.
Figure 2:
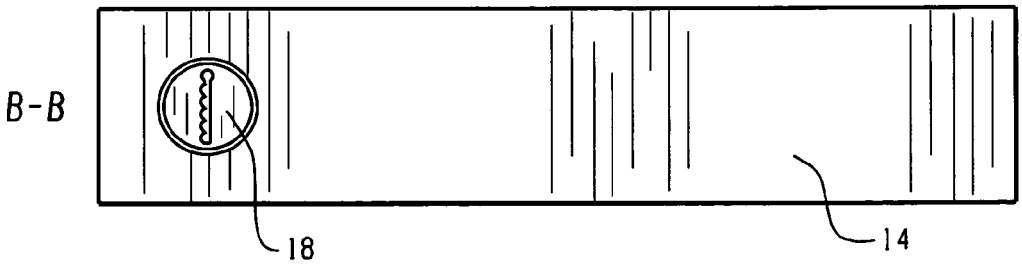
FIG. 2 is a top view of the clamp assembly of the present invention.

As shown in FIGS. 2–4, the clamp assembly 14 includes a top and bottom half secured together by a spring loaded hinge pin 24. The spring loaded hinge pin 24, normally holds the clamp 14 in an open position. A locking device 18 is needed to secure the two halves of the clamp 14 in a closed position. Additionally, the interior of the clamps 14 are covered with a soft insert 26 to protect the I/O panel connectors 32 positioned within the halves of the clamp assembly 14 from damage.

The clamp assembly 14 further contains openings 30 for securing the I/O panel connectors 32. These openings 30 retain the I/O connectors 32 and prevent removal of the connectors 32 by unauthorized users. Further, a soft insert 26 lines the interior of these openings 30, protecting the I/O connectors 32 from damage. Additionally, the clamp assembly 14 may contain openings for key pad access and/or for LED observation, depending on the wants and needs of the consumer.

As stated above, the clamp assembly 14 is held together by a locking device 18. The locking device 18 of the security system 10, is any suitable locking mechanism known in the art. Preferably, the locking device 18 is a cam lock 20, which is secured via a key. The locking device 18 prevents removal of the clamp assembly 14, once the clamp assembly 14 is clamped on the I/O connectos 32 and antennas 34. The cam lock engages the two halves of the clamp assembly 14, securing them together in a closed position. Then, the lock is secured via a key to prevent the clamp assembly 14 from opening.

Additionally, the locking device 18 is configurable for different levels of security, depending on the needs of the consumer. For example, a typical retail consumer would only require a low level of lock security, a commercial consumer would typically require a medium level of lock security, and a government, military, or banking consumer would require a high level of lock security. Therefore, the threat level would be matched to the locking device 18. For example, an inexpensive lock would be used for low level security consumers, and a pick-resistant lock would be used for high level security consumers.

In one embodiment, the clamp assembly 14 is secured around the I/O connectors 32 and then attached to the access point enclosure frame 12 as an integral part of the access point enclosure frame 12. The clamp assembly 14 is attached to the access point enclosure frame 12 via a capture plate 28 which extends from an end 15 of the clamp assembly 14, in the same plane. The capture plate 28 contains a ridge 29 at its end 31. This ridge 29 matingly engages a tab (not shown) on the lower half of the access point enclosure frame 12, connecting the clamp assembly 14 to the access point enclosure frame 12. Thus, when the clamp assembly 14 is secured around the I/O connectors 32 and locked in place, the capture plate 28 prevents removal of the clamp assembly 14 from the access point enclosure frame 12. The capture plate 28 also acts as a shield to protect tampering with the I/O connectors 32 between the clamp assembly 14 and the access point enclosure frame 12.

Figure 5:
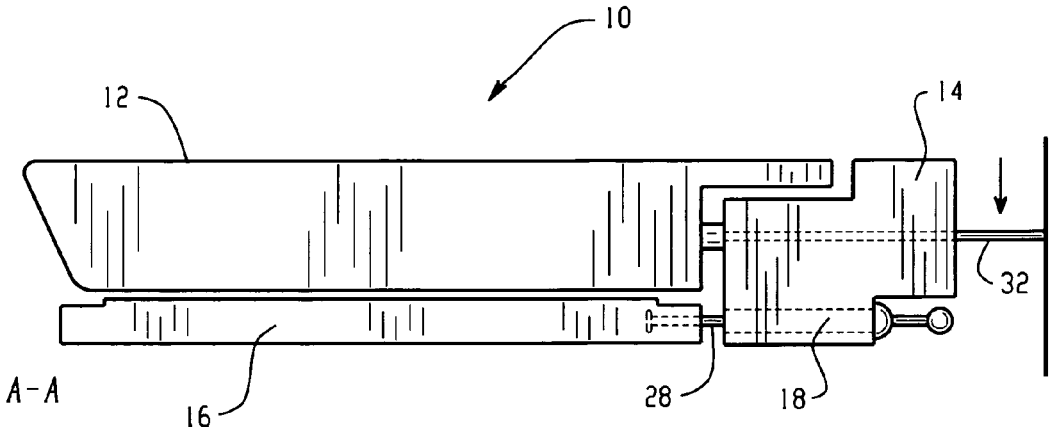
FIG. 5 is an elevation view of an alternative implementation of the security system of the present invention.

In another embodiment, the clamp assembly 14 is secured around the I/O connectors 32 and antennas 34 and then attached to a mounting bracket 16, which is then secured to the access point enclosure frame 12, as shown in FIG. 5. The mounting bracket 16 is attached to the lower half of the access point enclosure frame 12, allowing the access point enclosure frame 12 to be mounted in a desired location. The clamp assembly 14 is attached to a feature on the mounting bracket 16 via a cam attached to the locking device 18. Thus, when the clamp assembly 14 is secured around the I/O connectors 32 and antennas 34 and locked in place, the cam attached to the locking device 18 prevents removal of the clamp assembly 14 from the access point enclosure frame 12.

Figure 6:
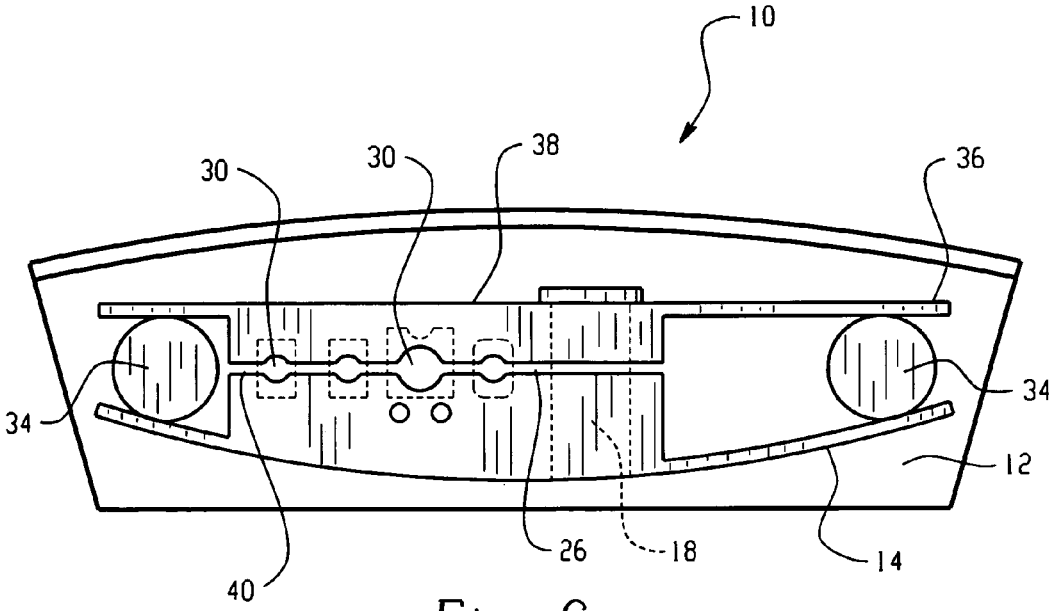
FIG. 6 is an elevation view of an alternative implementation of the security system of the present invention.

In another embodiment, the clamp assembly 14 is secured around the I/O connectors 32 and antennas 34, but is not attached to the access point enclosure frame 12 or mounting bracket 16, as shown in FIG. 6. A cover plate 38, a metal plate integral with the clamp assembly 14 is located at the top and bottom of the clamp assembly 14, which prevents removal of the I/O connectors 32 from their respective I/O ports on the access point enclosure frame 12. Additionally, metal extension "ears" or "outriggers" 36, an integral part of the clamp assembly 14, extend out over the antennas 34 to prevent removal of the antennas 34 from the access point enclosure frame 12. However, the clamp assembly 14 "ears" still permits the antennas 34 to rotate. Specifically, the "ears" capture a non-moving portion of the antennas 34 and allow the antennas 34 to rotate as they normally would without the security system attached. In this embodiment, a hook and relief 40, holds the two halves of the clamp assembly 14 together. As there is no connection to the access point enclosure frame 12 or the mounting bracket 16, the hook and relief 40 secures the clamp assembly 14 together, and the cover plates 38 prevent the disconnection of the I/O connectors 32 and antennas 34 from the enclosure frame 12, securing the access point assembly in place. The locking device 18 then locks the two halves of the clamp assembly together.

Figure 7:
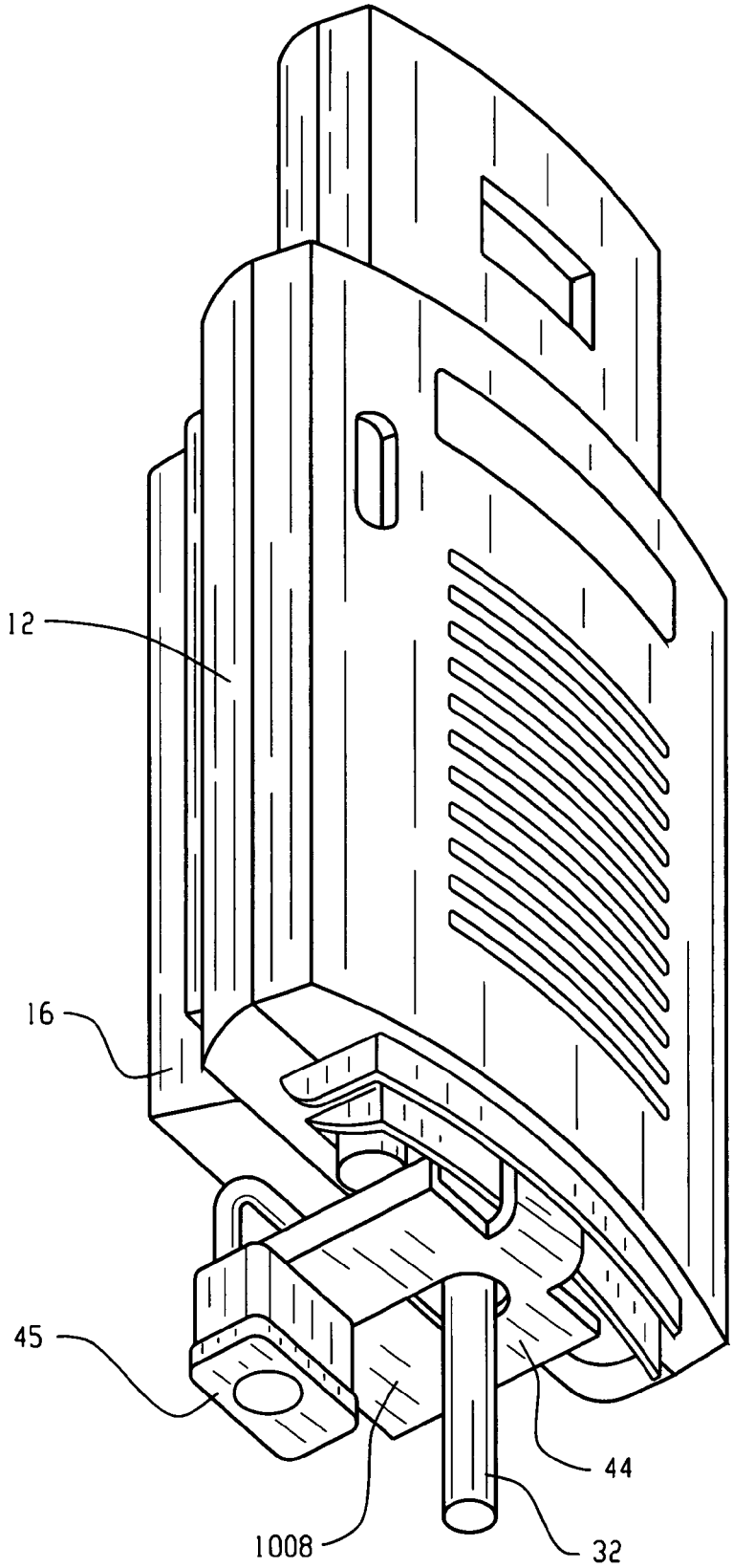
FIG. 7 is a perspective view of an alternative implementation of the security system of the present invention.

In another embodiment, a lock plate 44 is secured around I/O connector 32 and then attached to a mounting bracket 16, which is then secured to the access point enclosure frame 12, as shown in FIG. 7. Access Point 700 comprises an enclosure frame 12, mounting bracket 16, and I/O connector port 812 (FIG. 8) coupled to I/O connector 32. The mounting bracket 16 is attached to the lower half of the access point enclosure frame 12, allowing the access point enclosure frame 12 to be mounted in a desired location. The lock plate 44 matingly engages a "Kensington" lock-style hole 46 on the access point enclosure frame 12 and front surface 1008 of mounting bracket 16. Pad lock 45 attaches to lock plate 44 to secure the lock plate 44 in place to front surface 1008 of mounting bracket 16. Thus, when the lock plate 44 is secured around the I/O connectors 32 and antennas 34 and locked in place via the pad lock 45, the pad lock 45 attached to the lock plate 44 prevents removal of the lock plate 44 from the access point enclosure frame 12, mounting bracket 16, and retains and prevents the removal of I/O connector 32 from access point enclosure frame 12.

Figure 8:
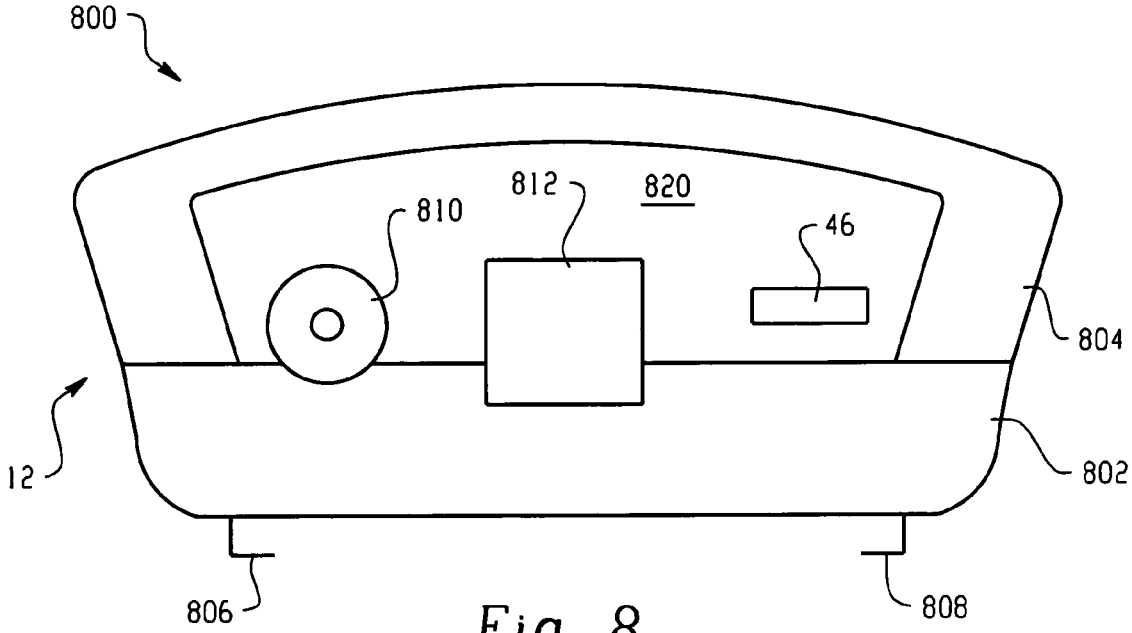
FIG. 8 is a front view of the access point enclosure frame for the embodiment illustrated in FIG. 7.
Figure 9:
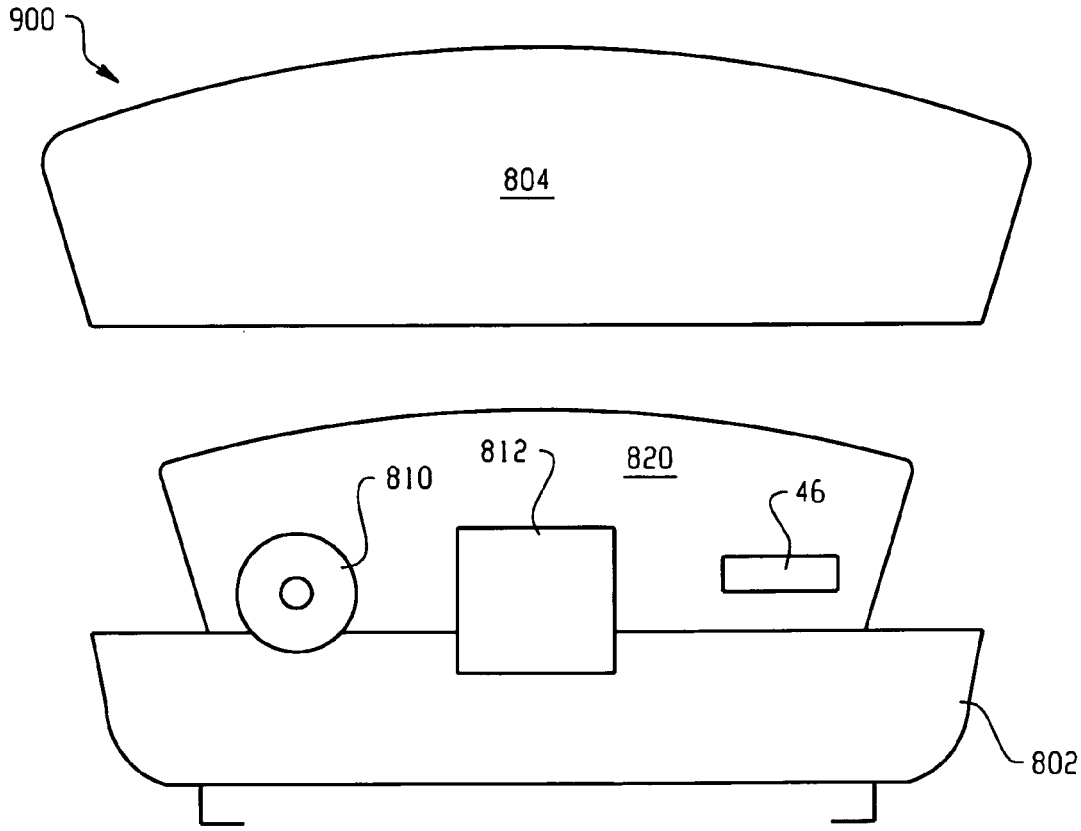
FIG. 9 is an exploded view of the access point enclosure frame illustrated in FIG. 8.

FIG. 8 is a front view 800 of the access point enclosure frame 12 for the embodiment illustrated in FIG. 7. Access point enclosure frame comprises a lower half 802 and an upper half 804. Lower half 802 of access point enclosure frame 12 has rails 806, 808 adapted to slideably engage mounting bracket 16. On the front of the lower half 802 of access point enclosure frame 12 are illustrated a power connection 810, I/O connector port 812 and a Kensington Style slot 46. FIG. 9 is an exploded view 900 of the access point enclosure frame illustrated in FIG. 8. FIG. 9 illustrates the upper half 804 of access point enclosure frame 12 separated from lower half 802 of access point enclosure frame 12.

Figure 10:
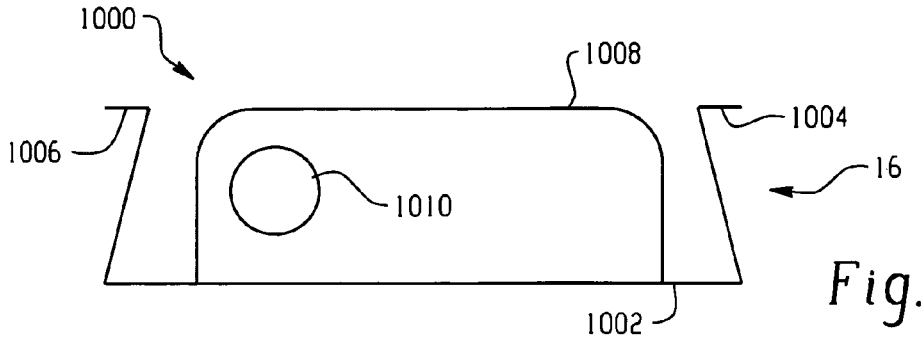
FIG. 10 is a front view of the mounting bracket for the embodiment illustrated in FIG. 7.
Figure 11:
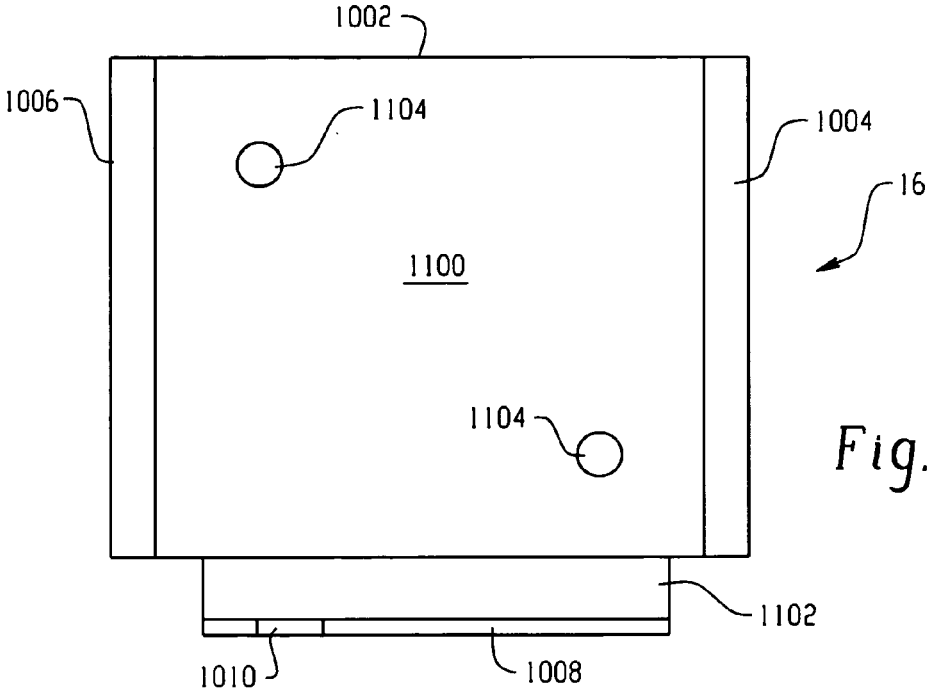
FIG. 11 is a top view of the mounting bracket illustrated in FIG. 10.

FIG. 10 is a front view 1000 of the mounting bracket 16 for the embodiment illustrated in FIG. 7. Mounting bracket 16 comprises rails 1004 and 1006 for engaging rails 806, 808 (FIG. 8) of access point enclosure frame 12. Mounting bracket 16 has a front surface 1008 coupled to the bottom surface 1002. Front surface 1008 has an aperture 1010, which as will be explained herein secures lock plate 44 to mounting bracket 16. FIG. 11 is a top view 1100 of the mounting bracket 16 illustrated in FIG. 10. Surface 1102 positions front surface 1008 and aperture 1010 to be in front of access point enclosure frame 12 when access point enclosure frame 12 is mounted onto mounting bracket 16. Bottom surface 1002 may comprise mounting holes 1104 enabling mounting bracket 16 to be mounted on an external surface such as a wall, ceiling, floor, etc.

Figure 12:
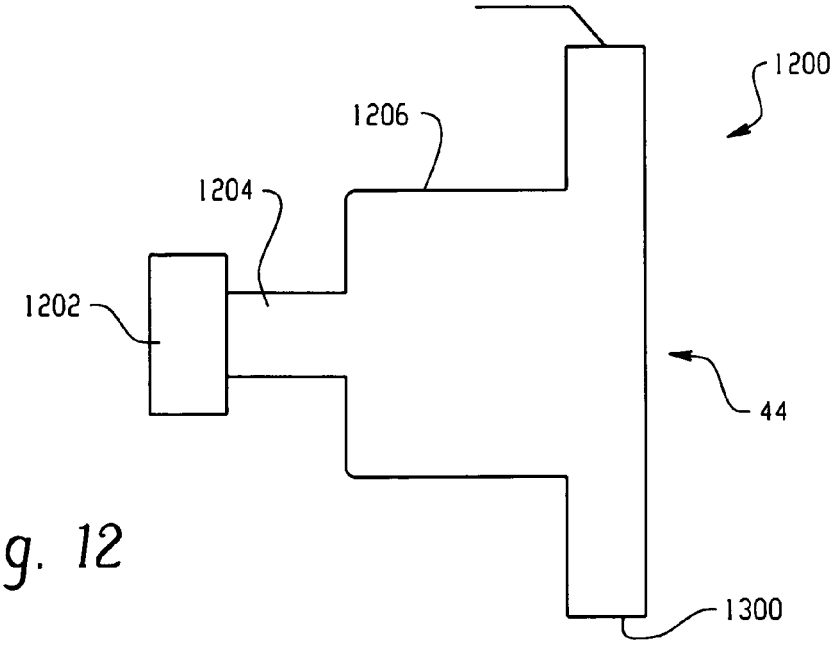
FIG. 12 is a side view of the lock plate for the embodiment illustrated in FIG. 7.

FIG. 12 is a side view 1200 of the lock plate 44 for the embodiment illustrated in FIG. 7. Lock plate 44 has a tab 1202 that is adapted to engage the Kensington style slot 46. When turned horizontally, tab 1202 fits into slot 46 allowing lock plate 44 to be installed or removed from the lower half 802 (FIG. 8) of access point enclosure frame 12. When turned vertically, tab 1202 is held in place by front surface 820 (FIGS. 8–9) of the lower half 802 (FIGS. 8–9) of access point enclosure frame 12. Neck 1204 is of sufficient length for tab 1202 to slide inside Kensington Style slot 46 (FIG. 8). Surface 1206 is approximately the length of surface 1102 (FIG. 11) so the front surface 1302 (see FIG. 13) of lock plate 44 slides next to the front surface 1008 of mounting bracket 16.

Figure 13:
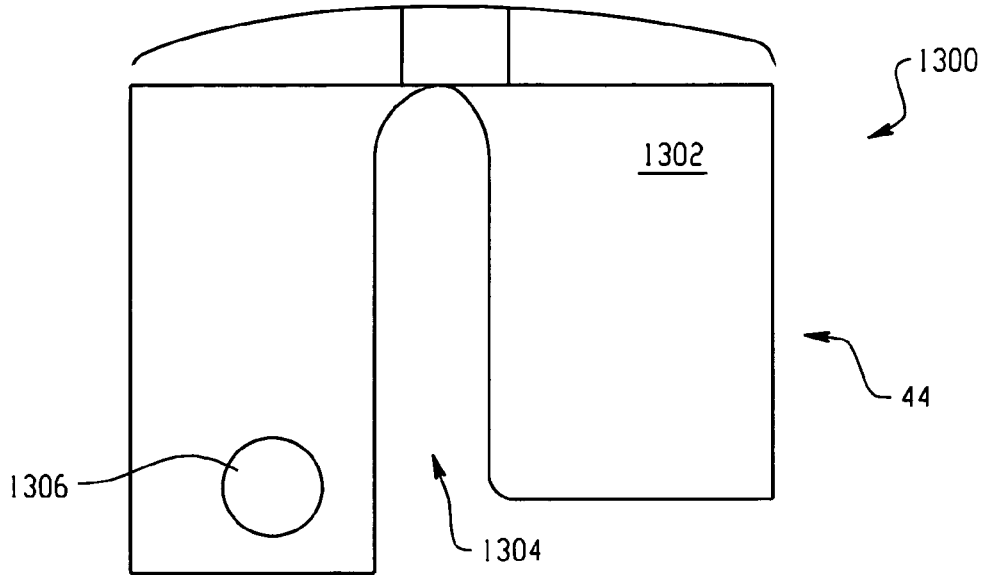
FIG. 13 is a front view of the lock plate illustrated in FIG. 12.

FIG. 13 is a front view 1300 of the lock plate illustrated in FIG. 12. Lock plate 44 comprises a front surface 1302 that has a slot 1304 and an aperture 1306. As was illustrated in FIG. 7 and will be further illustrated in FIG. 14, when lock plate 44 is engaged with lower half 802 (FIG. 8) of access point enclosure frame 12 and in the closed position, aperture 1306 aligns with aperture 1010 (FIGS. 10–11). Pad lock 45 passes through aperture 1306 and aperture 1010 and holds lock plate 44 to mounting bracket 16. When lock plate 44 is not engaging access point enclosure frame 12, slot 1304 enables an I/O connector (not shown—see for example FIG. 1 or FIG. 5) to slide through, which can be coupled to I/O port 812. However, as illustrated in FIG. 7 and will be illustrated in FIG. 14, when lock plate 44 is engaged, surface 1302 prevents access to I/O port 812 and removal of an I/O connector plugged into port 812 which passes through slot 1304.

Figure 14:
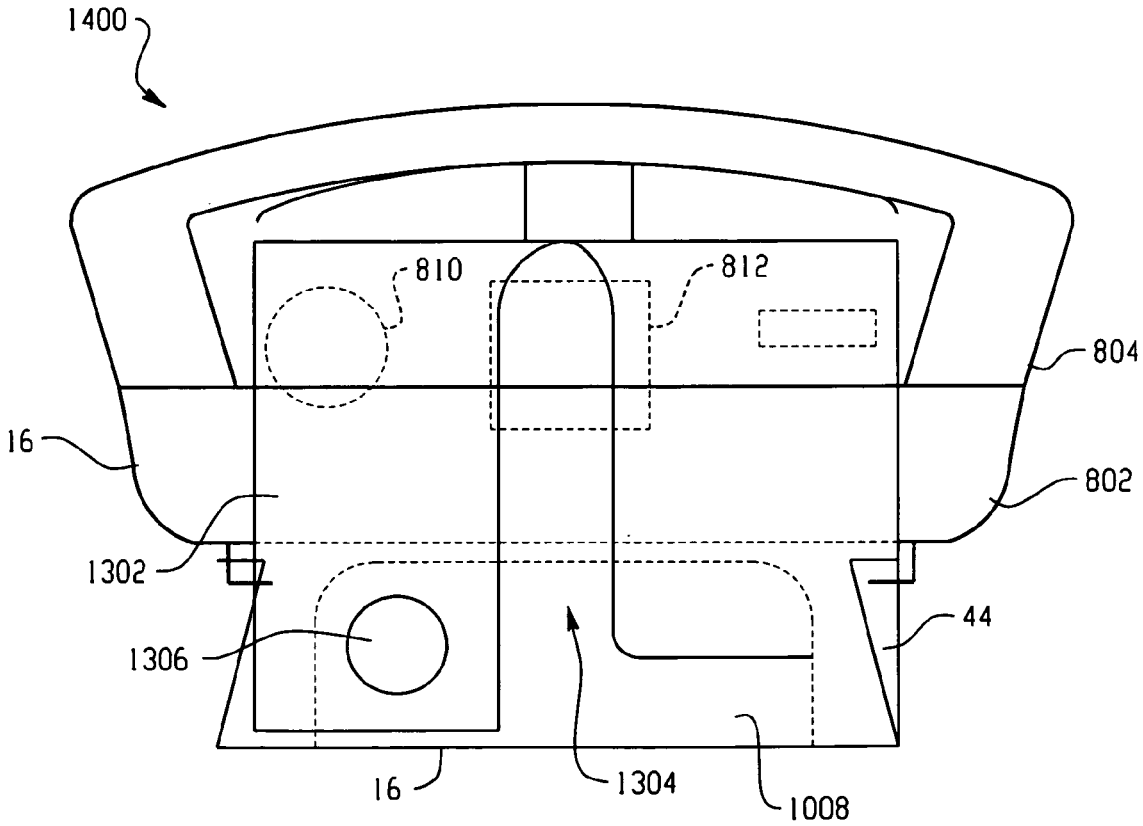
FIG. 14 is a front view illustrating the enclosure frame engaging the mounting plate and the lock plate engaging the enclosure frame and the mounting bracket.

FIG. 14 is a front view 1400 illustrating the access point enclosure frame 12 engaging the mounting plate 16 and the lock plate engaging 44 access point enclosure frame 12 and mounting bracket 16. As explained previously, slot 1212 of lock plate 44 engages the Kensington style slot 46. When lock plate 44 is in the position illustrated in FIG. 14, Tab 1202 cannot be removed from Kensington Style slot 46. Aperture 1306 aligns with aperture 1010 of mounting bracket 16. When locking device 45 is inserted through apertures 1306 and 1010, this fastens lock plate 44 to mounting bracket 16. Surface 1304 covers and prevents access to power connection 810. Furthermore, slot 1304 allows an I/O connector (not shown—see for example FIG. 1 or FIG. 5) to be plugged into I/O connector port 812, while surface 1304 surrounds I/O port 812 and prevents access to I/O connector port 812. Thus, when engaged, lock plate 44 prevents the removal of access point enclosure frame 12 from mounting bracket 16 and prevents access to an I/O connector connected to port 812 coupled to access point enclosure frame 12.

Although the preferred embodiment has been described in detail, it should be understood that various changes, substitutions, and alterations can be made therein without departing from the spirit and scope of the invention as defined by the appended claims. It will be appreciated that various changes in the details, materials and arrangements of parts, which have been herein described and illustrated in order to explain the nature of the invention, may be made by those skilled in the area within the principle and scope of the invention as will be expressed in the appended claims.

The invention claimed is:

1. A system for physically securing an access point, comprising:

an access point enclosure frame having a lower portion, the lower portion having at least one Input/Output (I/O) connector port;

a mounting bracket attached to the lower portion of the access point enclosure frame, the mounting bracket having an aperture on a front surface;

an enclosure mechanism for enclosing at least a portion of the I/O connector port, the enclosure mechanism comprises a slot to retain and prevent removal of an I/O connector from the I/O connector port, the enclosure mechanism matingly engages the lower half of the access point enclosure frame, the enclosure frame further comprising an aperture on a front surface that aligns with the aperture on the front surface of the mounting bracket; and a locking device attached to the enclosure mechanism for securing the enclosure mechanism in a closed position;

wherein when the locking device is engaged, the locking device engages the aperture of the mounting bracket and the aperture of the enclosure mechanism and prevents removal of the enclosure mechanism from the mounting bracket thereby securing the access point enclosure frame to the mounting bracket and retaining and preventing removal of the connector from the access point enclosure frame.

2. The security system of claim 1 wherein the I/O connector is selected from the group consisting of Ethernet connectors, fiber connectors, console port connectors, and antennas.

3. The security system of claim 2 wherein the enclosure mechanism is a clamp assembly.

4. The security system of claim 3 wherein the locking device is a cam lock and is secured via a key.

5. The security system of claim 4 wherein the locking device is configurable for different levels of security.

6. The security system of claim 2 wherein the enclosure mechanism is a lock plate.

7. The security system of claim 1 wherein the locking device is a pad lock, which secures the lock plate around the at least one I/O connector.

8. The security system of claim 1, further comprising:

the lower portion of the access point enclosure frame further comprising a Kensington style slot for matingly engaging the enclosure mechansim; and the enclosure mechanism further comprising a tab for engaging the Kensington style slot wherein when the enclosure mechanism unlocked the tab can be removed from the Kensington style slot and when the enclosure mechanism is locked the tab can not be removed from the Kensington style slot thereby securing the enclosure mechanism to the access point enclosure frame.

* * * * *